US011920431B2

(12) United States Patent
Solland

(10) Patent No.: US 11,920,431 B2
(45) Date of Patent: Mar. 5, 2024

(54) VALVE ASSEMBLY, A PRODUCTION TUBING SYSTEM AND A PRODUCTION TUBING SUB

(71) Applicant: Interwell Norway AS, Hafrsfjord (NO)

(72) Inventor: Erik Åsmund Glennsjø Solland, Hafrsfjord (NO)

(73) Assignee: Interwell Norway AS, Hafrsfjord (NO)

( * ) Notice: Subject to any disclaimer, the term of this patent is extended or adjusted under 35 U.S.C. 154(b) by 0 days.

(21) Appl. No.: 17/756,687

(22) PCT Filed: Nov. 4, 2020

(86) PCT No.: PCT/EP2020/080986
§ 371 (c)(1),
(2) Date: May 31, 2022

(87) PCT Pub. No.: WO2021/121759
PCT Pub. Date: Jun. 24, 2021

(65) Prior Publication Data

US 2022/0412188 A1 Dec. 29, 2022

(30) Foreign Application Priority Data

Dec. 20, 2019 (NO) ..... 20191509

(51) Int. Cl.
*E21B 34/10* (2006.01)

(52) U.S. Cl.
CPC ..... *E21B 34/102* (2013.01); *E21B 2200/05* (2020.05)

(58) Field of Classification Search
CPC ..... E21B 34/08; E21B 34/10; E21B 34/102; E21B 2200/05
See application file for complete search history.

(56) References Cited

U.S. PATENT DOCUMENTS 4,890,674 A * 1/1990 Le ..... E21B 34/105 251/63.4
6,808,020 B2 10/2004 Garcia
(Continued)

FOREIGN PATENT DOCUMENTS

NO 343864 B1 6/2019
WO 2014/203155 A1 12/2014

OTHER PUBLICATIONS

International Search Report issued in PCT/EP2020/080986, dated Jan. 18, 2021 (4 pages).
(Continued)

*Primary Examiner* — Matthew R Buck
(74) *Attorney, Agent, or Firm* — Osha Bergman Watanabe & Burton LLP

(57) ABSTRACT

A valve assembly for connection to an opening provided in a housing of a well tool device includes a fluid communication channel, a flapper valve device, a flapper element supporting device, and a securing device. The fluid communication channel provides fluid communication from an outside of the housing to a bore provided on the inside of the housing. The flapper valve device includes a flapper element configured to be in a closed position in which the fluid communication channel is closed and an open position in which the fluid communication channel is open. The flapper element is biased to the closed position. The flapper element supporting device supports the flapper element when the flapper element is in the open position. The securing device secures the flapper valve device and the flapper element supporting device to the opening. The securing device includes a through bore forming a first part of the fluid communication channel.

19 Claims, 9 Drawing Sheets

(56) References Cited

U.S. PATENT DOCUMENTS

| | | | | |
|---|---|---|---|---|
| 7,845,433 | B2 * | 12/2010 | Calderoni | E21B 21/106 175/317 |
| 9,518,444 | B2 | 12/2016 | Thompson | |
| 10,221,655 | B2 * | 3/2019 | Phi | E21B 34/16 |
| 2008/0035353 | A1 | 2/2008 | Hughes et al. | |
| 2012/0085548 | A1 | 4/2012 | Fleckenstein et al. | |
| 2014/0041876 | A1 | 2/2014 | Fleckenstein et al. | |

OTHER PUBLICATIONS

Written Opinion of the International Searching Authority PCT/EP2020/080986, dated Jan. 18, 2021 (6 pages).
Search Report issued in counterpart Norwegian Patent Application No. 20191509, dated Jun. 17, 2020 (2 pages).

* cited by examiner

Undesired fluid flow

Desired fluid flow

VALVE ASSEMBLY, A PRODUCTION TUBING SYSTEM AND A PRODUCTION TUBING SUB

FIELD OF THE INVENTION

The present invention relates to a valve assembly, a production tubing system and a production tubing sub for such a production tubing system. The present invention also relates to a method for installing and testing of such a production tubing system.

BACKGROUND OF THE INVENTION

A production tubing system is installed in a hydrocarbon producing well with the main purpose of transporting oil/gas up to the topside of the well. Such a production tubing is also referred to as a completion string. Typically, the production tubing system is hung off in a tubing hanger and installed as one of the final steps before production can start.

The production tubing system must be pressure tested before production can start.

One object of the present invention is to reduce the time required to install and test the production tubing system.

Some parts of the production tubing system may require well intervention operations, i.e. that equipment, tools etc. are lowered into the production tubing system for a specific purpose (for example to open a valve, to close a valve, to set a plug, to retrieve a plug etc).

Another object of the present invention is to reduce the amount of equipment needed to install and test the production tubing system and to avoid or reduce the number of well intervention operations.

SUMMARY OF THE INVENTION

The present invention relates to a valve assembly for connection to an opening provided in a housing of a well tool device; where the valve assembly comprises:

- a fluid communication channel providing fluid communication from an outside of the housing to a bore provided on the inside of the housing;
- a flapper valve device comprising a flapper element configured to be in a closed position in which the fluid communication channel is closed and an open position in which the fluid communication channel is open; where the flapper element is biased to its closed position;
- a flapper element supporting device for supporting the flapper element when the flapper element is in its open position;
- a securing device for securing the flapper valve device and the flapper element supporting device to the opening; where the securing device comprises a through bore forming a first part of the fluid communication channel.

In one aspect, the flapper element is configured to be brought from its closed position to its open position when a force created by the differential fluid pressure between the outside of the housing and the bore is above a predetermined threshold value.

In one aspect, the predetermined threshold value is given by the biasing force of the biased flapper element. The predetermined threshold value is positive, i.e. the fluid pressure on the outside of the housing must be larger than the fluid pressure in the bore.

In one aspect, the flapper valve device comprises a flapper aligning body configured to be aligned in a predetermined position with respect to the housing, where the flapper element is pivotably connected to the flapper aligning body.

In one aspect, the flapper valve device comprises a spring device biasing the flapper element in relation to the flapper aligning body.

As the flapper aligning body is configured to be aligned in a predetermined position with respect to the housing, the spring device is also biasing the flapper element with respect to the housing when the valve assembly is connected to the opening of the housing.

In one aspect, the flapper aligning body comprises a pin opening, the flapper element comprises a pin opening and where the aligning body, the flapper element and the spring device is connected to each other by means of a pin fastener. The flapper element may be pivoted with respect to the flapper aligning body as long as the pivoting force is larger than the biasing force provided by the spring device.

In one aspect, the flapper element supporting device comprises a flapper element supporting body comprising a stop element for preventing the flapper element from protruding into the bore when the flapper element is in its open position.

In one aspect, the flapper element supporting body comprises a fluid guiding surface facing towards the flapper element.

In one aspect, the stop element is not protruding into the bore of the housing. Hence, fluid flow through the bore is not restricted by any parts of the valve assembly.

In addition, it is achieved intervention tools may pass through the bore without being restricted by any parts of the valve assembly.

In one aspect, the fluid communication channel has a longitudinal axis provided in parallel with the longitudinal axis of the valve assembly. In one aspect, the longitudinal axis of the valve assembly is perpendicular to the longitudinal axis of the housing of the well tool device.

In one aspect, the flapper element is oriented in parallel with the longitudinal axis of the housing. The flapper element is oriented with an angle $\alpha$ between 5°-45° with respect to the longitudinal axis of the housing in the open position.

In one aspect, a rotation axis of the flapper element is perpendicular to the longitudinal axis of the housing. In one aspect, the rotation axis of the flapper element is also perpendicular to the longitudinal axis of the valve assembly. In one aspect, the rotation axis of the flapper element is provided in the upper part of the opening.

In one aspect, the aligning body and the flapper element supporting body are both generally U-shaped, where the ends of the generally U-shaped bodies are facing each other, thereby forming a substantially circular compartment forming a second part of the fluid communication channel.

In one aspect, there are two or more such stop elements, one in each end of the generally U-shaped flapper element supporting body. The fluid guiding surface may be provided between the two stop elements.

In one aspect, the securing device comprises a securing body having a flapper element facing surface facing towards the flapper element, the flapper element facing surface comprising a recess in which a sealing element is provided, where the flapper element is sealingly engaged towards the flapper element facing surface when the flapper element is in its closed state.

In one aspect, the securing body comprises a recess in which a sealing element is provided, where the sealing element is configured to prevent fluid flow through the opening radially outside of the securing body.

In one aspect, the sealing body comprises threads for securing the sealing body to threads provided in the opening. Alternatively, screws or other types of fasteners may be used to secure the sealing body to the opening of the housing.

In one aspect, the securing device comprises a filter to prevent debris from entering the fluid communication channel.

In one aspect, the filter is connected to the securing body by means of screws or other fasteners.

In one aspect, the bore is a through bore provided in the housing. The longitudinal center axis of the through bore may be aligned with the longitudinal center axis of the housing. Alternatively, the longitudinal center axis of the trough bore may be eccentric with regard to the longitudinal center axis of the housing.

In one aspect, the fluid communication between the outside of the housing and the bore is provided in a radial direction.

In one aspect, the well tool device may be a production tubing sub.

The present invention also relates to a production tubing sub for a production tubing system, where the production tubing sub comprises:

a housing comprising a longitudinal through bore, where the through bore is configured to be provided in fluid communication with a longitudinal through bore of a production tubing;

an opening provided radially in the housing;

a valve assembly according to the above, secured to the opening of the housing.

In one aspect, the production tubing sub further comprises an axially displaceable sleeve configured to be displaced between a first sleeve position in which fluid flow through the valve assembly is allowed, and second sleeve position in which fluid flow through the valve assembly is prevented, even if the fluid pressure difference between the outside of the housing and the inside of the housing is larger than the predetermined fluid pressure threshold value.

In one aspect, the sleeve is provided radially inside of the valve assembly. Alternatively, the sleeve may be provided radially outside of the valve assembly.

The present invention also relates to a production tubing system for an oil and/or gas well, comprising:

a production tubing comprising a through bore in its longitudinal direction;

a tubing hanger for hanging off the production tubing in the well;

an upper safety valve located in the upper part of the production tubing;

a first, lower valve located in the lower part of the production tubing;

a packer assembly for closing of an annulus outside of the production tubing above the lower valve;

characterized in that the system further comprises:

a production tubing sub according to the above located in the production tubing above the lower valve.

In one aspect, the production tubing sub is located in the production tubing below the packer assembly.

In one aspect, the system further comprises a second, upper valve located in the upper part of the production tubing.

In one aspect, the first, lower valve is fluid pressure actuated. In one aspect, the second, upper valve is fluid pressure actuated.

In one aspect, the first, lower valve has an initially closed state. The first lower valve can, when actuated, be brought to a permanently open state.

In one aspect, the second, upper valve has an initially open state. It can, when actuated, be brought to a temporarily closed state and then to a permanently open state.

The present invention also relates to a method for installing a production tubing system in a well, comprising the steps of:

lowering a production tubing comprising a longitudinal through bore into the well, where an initially closed lower valve is located in the lower part of the production tubing, where an upper safety valve is located in the upper part of the production tubing; and where a production tubing sub is located in the production tubing above the lower valve;

allowing well fluid to enter the through bore via a valve assembly secured to an opening of a housing of the production tubing sub during the lowering of the production tubing into the well;

closing the valve assembly by increasing the pressure inside the bore with respect to the pressure outside of the production tubing;

setting a packer assembly in an annulus outside of the production tubing above the production tubing sub by means increasing the pressure inside the bore.

In one aspect, the method further comprises the step of:

testing the integrity of the packer assembly by increasing the pressure in the annulus radially outside of the production tubing above the packer assembly;

verifying the integrity of the packer assembly if no fluid flow up through the bore of the tubing string via the valve assembly is detected; or verifying a failed integrity of the packer assembly if fluid flow up through the bore of the tubing string via the valve assembly is detected.

In one aspect, the method further comprises the step of:

opening the lower valve if the integrity of the packer assembly has been verified.

In one aspect, the step of allowing well fluid to enter the through bore is performed as long as the differential fluid pressure between the outside of the housing and the bore is above a predetermined threshold value.

In one aspect, the predetermined threshold value is given by the biasing force of the biased flapper element of the valve assembly.

DETAILED DESCRIPTION

Embodiments of the present invention will now be described in detail below, with reference to the enclosed drawings, wherein:

FIG. 1 schematically illustrates an embodiment of the production tubing system installed in a well;

Figure 14A:
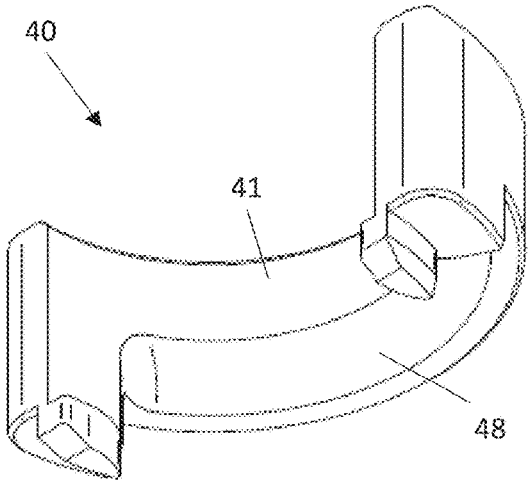
Figure 14B:
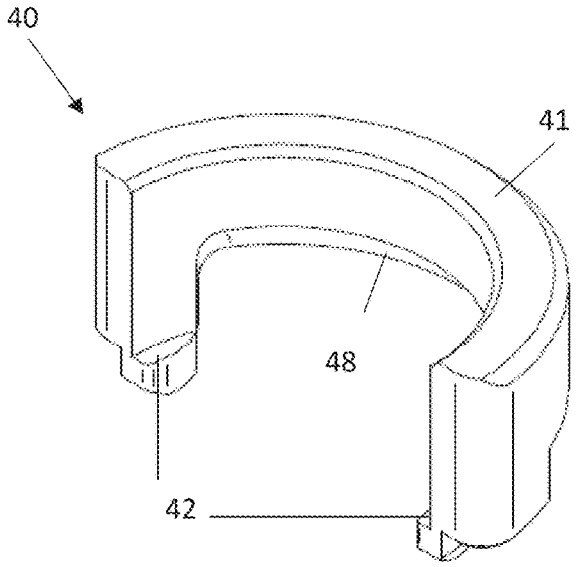
Figure 14C:
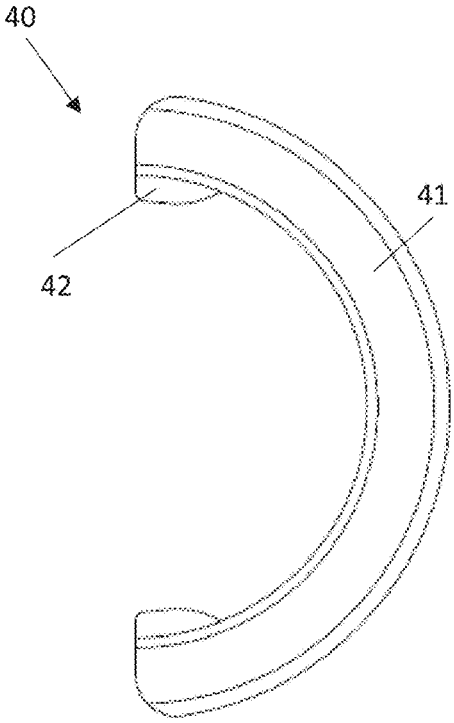
Figure 14D:
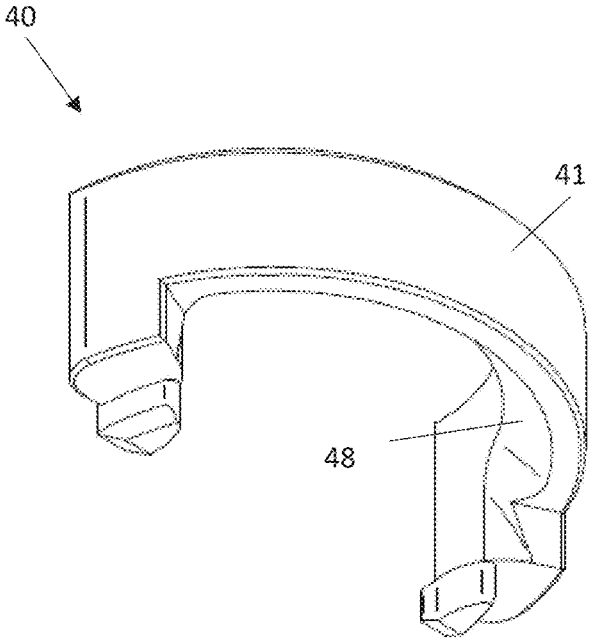
Figure 14E:
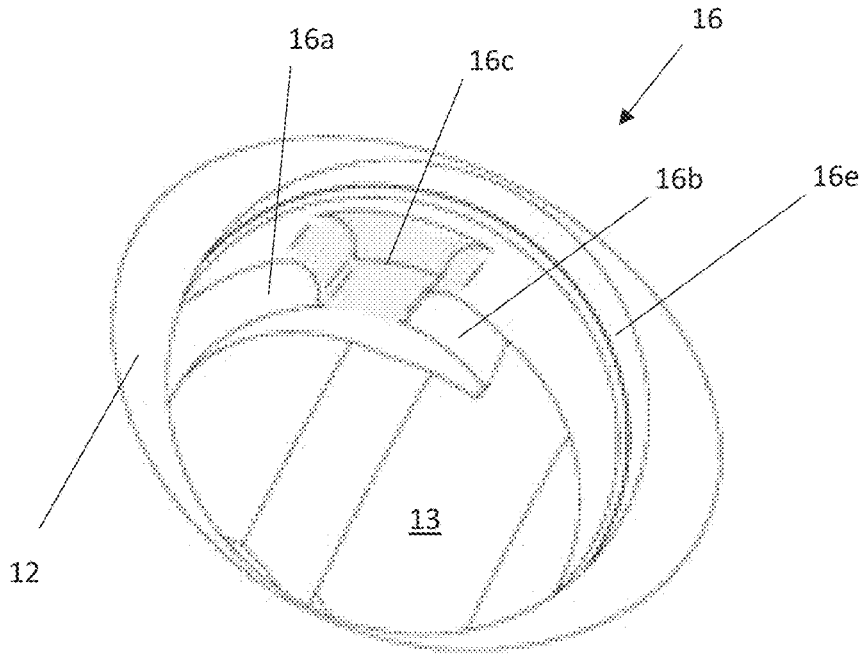
Figure 14F:
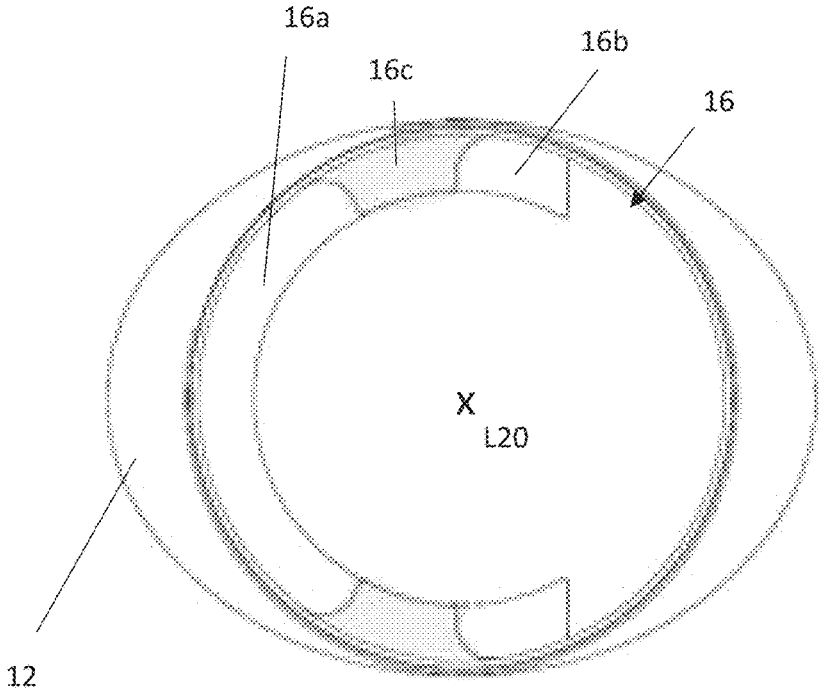
Figures 15A, 15B, 15C:
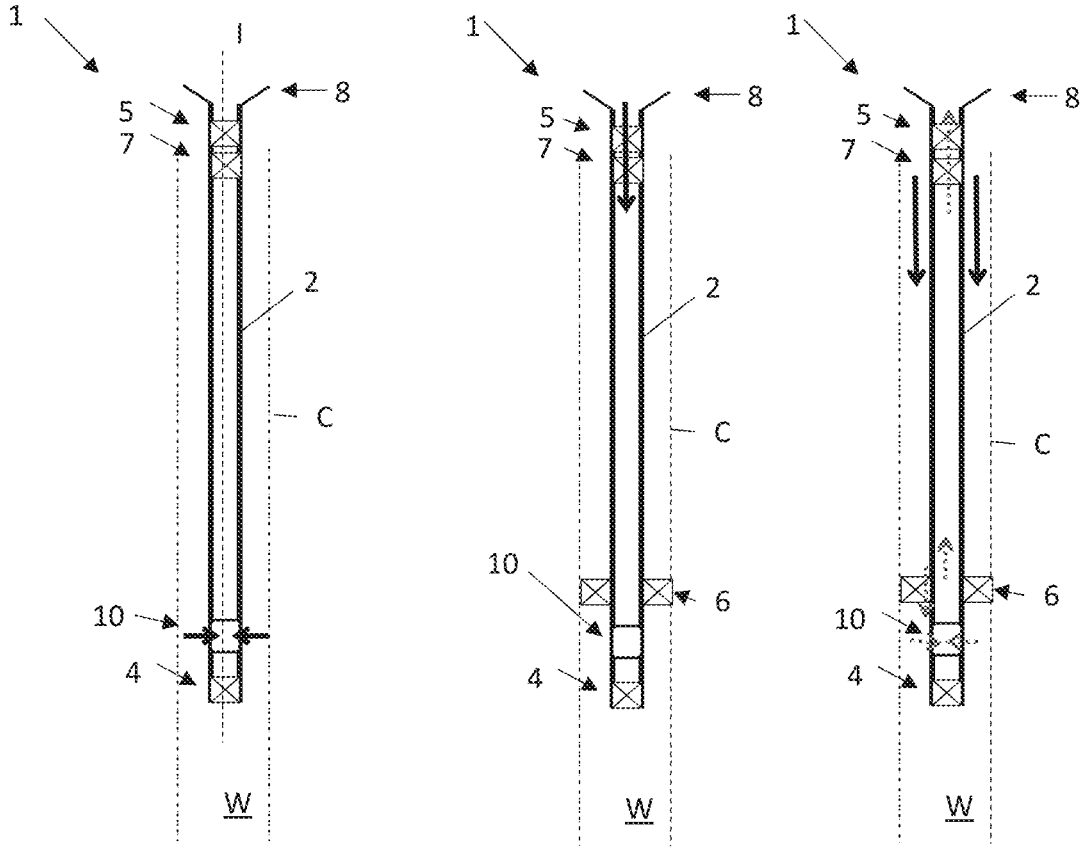
Figure 16:
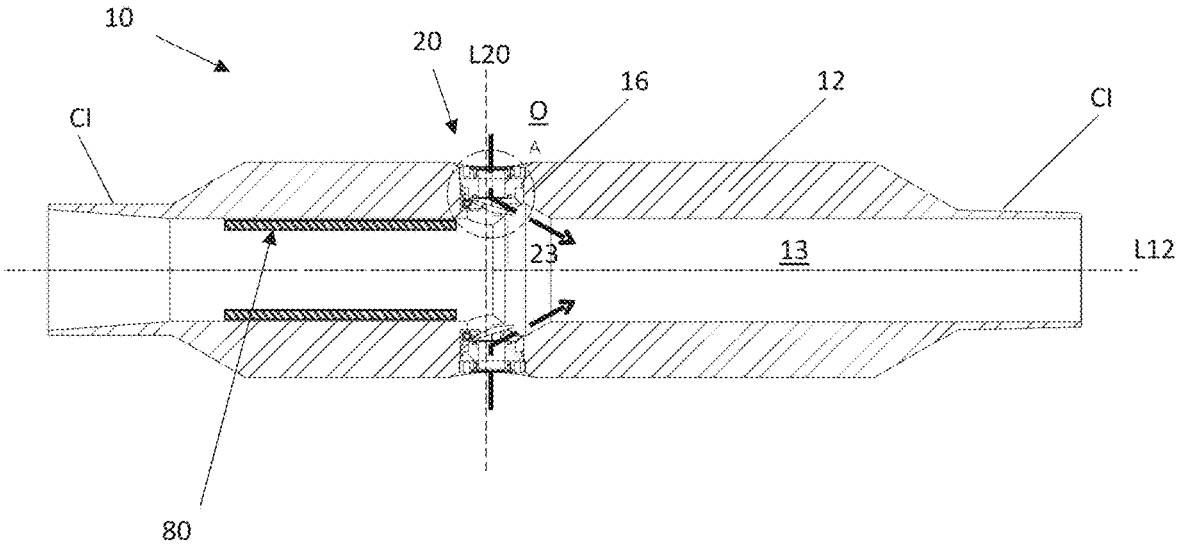
Figure 17:
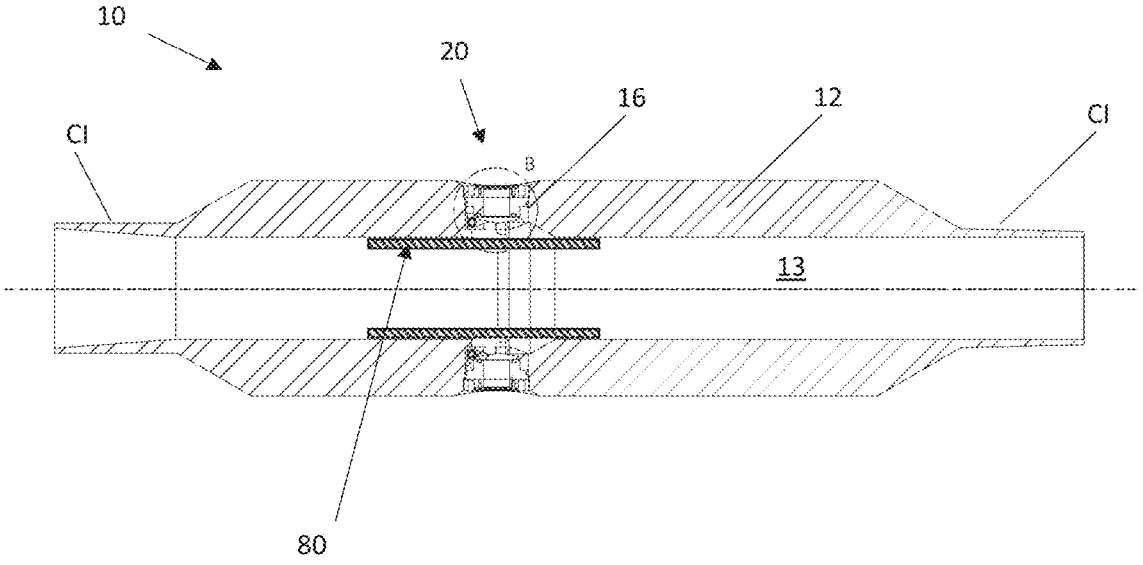

FIG. 14*a-d* illustrate details of the flapper element supporting device;

FIG. 14*e-f* illustrate details of the opening in the housing;

FIG. 15*a-c* illustrates details of the valve of the production tubing sub;

FIGS. 16 and 17 illustrates an alternative embodiment of the production tubing sub.

Figure 1:
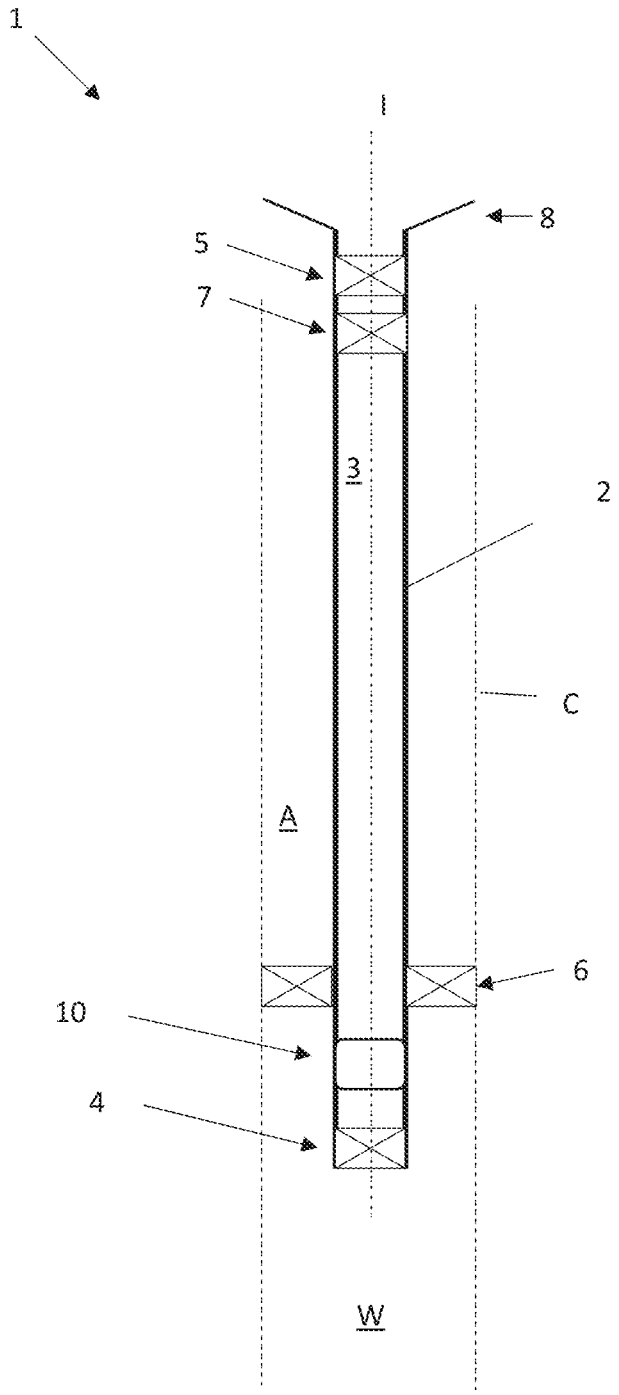

It is now referred to FIG. 1, in which a well W is shown with dashed lines. The wall of the well W typically comprises sections of subterranean formation, casing pipes C cemented to the subterranean formation etc.

Inside the well W, a production tubing system 1 is shown, comprising a production tubing or pipe 2, typically comprising sections of pipe connected to each other. The production tubing 2 is hung off in a topside tubing hanger 8. The production tubing 2 comprises a fluid bore 3 in which fluid/gas is transported up from the well W or down into the well W.

The production tubing system 1 further comprises a first or lower valve 4 provided in the lower part of the production tubing 2 and a second or upper valve 5 provided in the upper part of the production tubing 2.

The production tubing system 1 further comprises a so-called packer assembly 6 located radially outside of the production tubing 2 and above the lower valve 4. The packer assembly 6 seals off the so-called annulus A radially between the casing of the well W and production tubing 2 and hence prevents fluid flow in the direction of the production tubing up or down the annulus.

The production tubing system 1 further comprises an upper safety valve 7 located above or below the upper valve 5. The safety valve 7 is typically referred to as a down hole safety valve or abbreviated DHSV.

It should be noted that in FIG. 1*a*, the upper part of FIG. 1 is faced towards the topside of the well W, while the lower part of FIG. 1 is faced towards the bottom of the well. It should be noted that even though the production tubing 2 is oriented vertically in FIG. 1, the lower parts of the production tubing may be inclined with respect to the vertical axis or the lower parts of the production tubing may even be horizontal. Hence, the terms "upper", "above" etc. should be interpreted as "closer to the topside of the well", while the terms "lower", "below", etc. should be interpreted as "closer to the bottom of the well".

The lower valve 4 will be shortly described. The lower valve 4 is closed in its initial state, but will be opened when oil/gas production is to start. The lower valve 4 is considered known per se, and may for example be a valve sold under the name Inter Remote Shatter Valve (IRSV) which is described in "Product Sheet: Inter Remote Shatter Valve (IRSV) Rev. 6.0 Date: 13 Jun. 2019" published by Interwell.

The upper valve 5 will now be shortly described. The upper valve 5 is initially open, but can be brought to a temporarily closed state before it is brought to a permanent open state when oil/gas production is to start. The upper valve 5 is considered known per se, and may for example be a valve like the one described in NO 343864. This valve is sold under the name Inter Remote Bypass Valve (IRBV).

The packer assembly 6 is also considered known per se.

It should be noted that the production tubing system 1 may comprise other types of lower and upper valves 4, 5 than the examples described above. It should also be noted that the upper valve 5 is not essential for the system 1.

The production tubing system 1 further comprises a production tubing sub 10 connected between two sections of production tubing 2. The production tubing sub 10 will be described in detail below.

As shown in FIG. 1, the production tubing sub 10 is located above the lower valve 4, but below the packer assembly 6.

Figure 2:
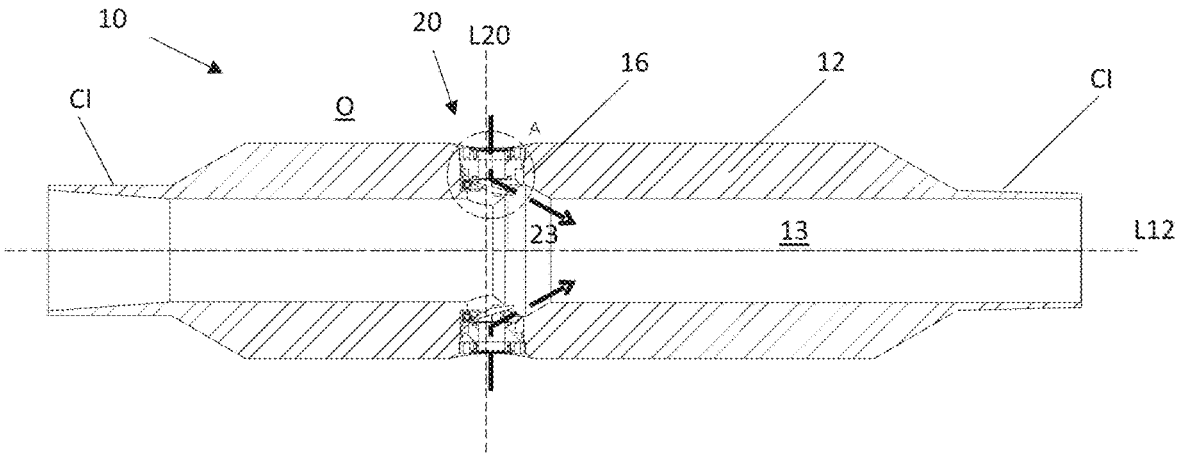
FIG. 2 illustrates a production tubing sub of the production tubing system in FIG. 1 in the open state.
Figure 3:
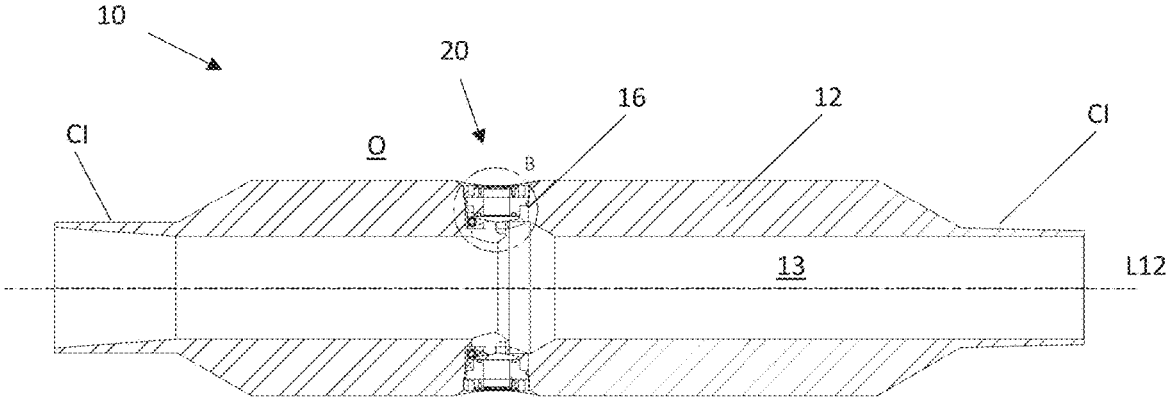
FIG. 3 illustrates a production tubing sub of the production tubing system in FIG. 1 in the closed state.
Figure 4:
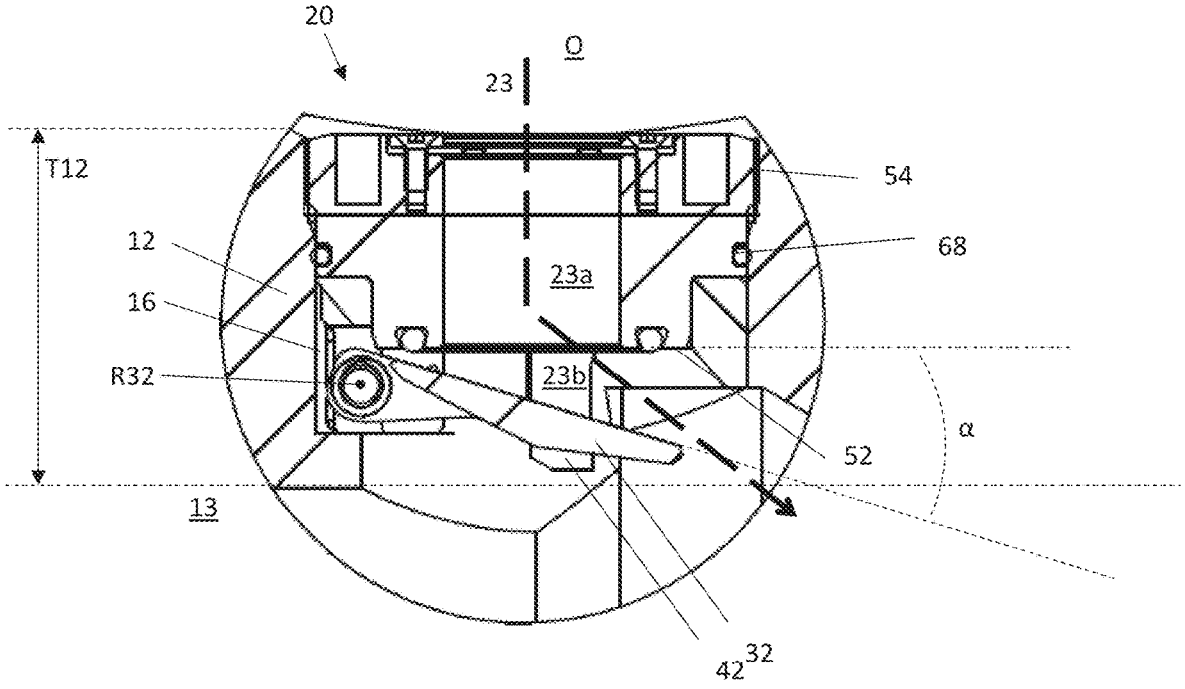
FIG. 4 illustrates an enlarged view of detail A of FIG. 2.
Figure 5:
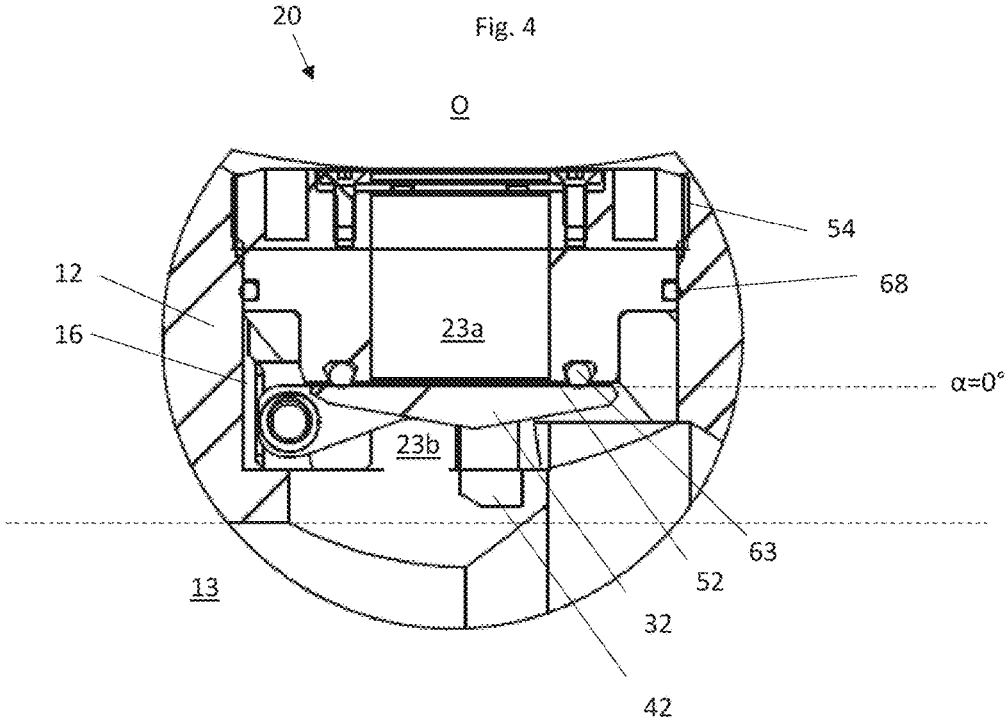
FIG. 5 illustrates an enlarged view of detail B of FIG. 3.
Figure 6:
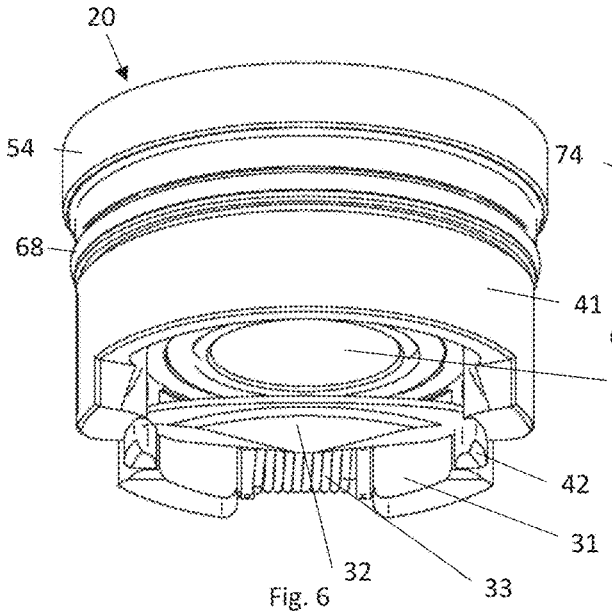
FIG. 6 illustrates a perspective view from below of the valve assembly.
Figure 7:
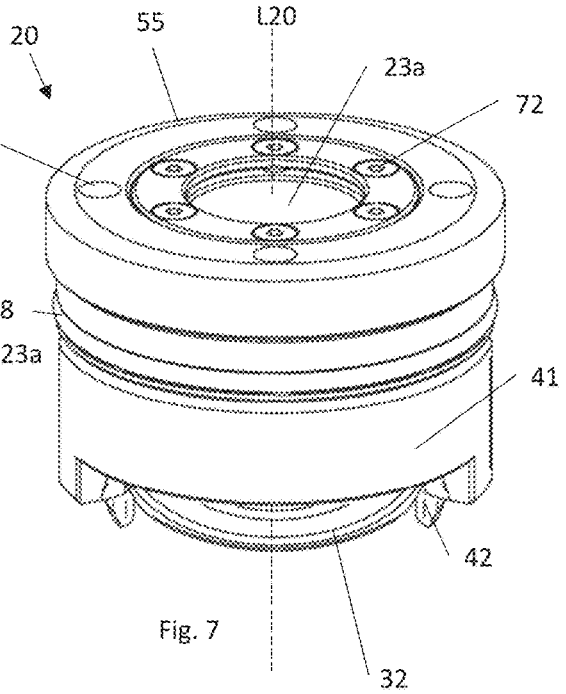
FIG. 7 illustrates a perspective view from below of the valve assembly.

It is now referred to FIGS. 2 and 3, and to the details of FIGS. 2 and 3 shown in FIGS. 4 and 5. Here, the production tubing sub 10 is shown to comprise a housing 12 and a through bore 13 provided axially through the housing 12. The longitudinal center axis of the housing 12 is shown as a dashed line L12. In the present embodiment, this dashed line L12 coincides with the longitudinal center axis of the bore 13. It should be noted that in an alternative embodiment, the longitudinal center axis of the through bore 13 may be eccentric or parallel to the longitudinal center axis L12 of the housing 12.

The housing 12 comprises upper and lower connection interfaces CI for connection to other production tubing strings. Typically, these are threaded connection interfaces.

The housing 12 further comprises a valve assembly 20 provided in an opening 16 in the housing 12 between an outside O of the housing 12 and the bore 13.

The valve assembly 20 comprises a fluid communication channel 23 providing fluid communication from the outside O of the housing 12 to the bore 13, as indicated by a dashed arrow in FIG. 2.

In FIGS. 2 and 3, a longitudinal axis L20 of the valve assembly 20 is indicated as a dashed line. The longitudinal axis L20 is provided in a radial direction, i.e. perpendicular to the longitudinal center axis L12.

In FIG. 2, the fluid communication channel 23 is open, as indicated by a dashed arrow 23. In FIG. 3 the fluid communication channel 23 is closed, and no fluid flow is allowed between the bore 13 and the outside O.

Figure 11:
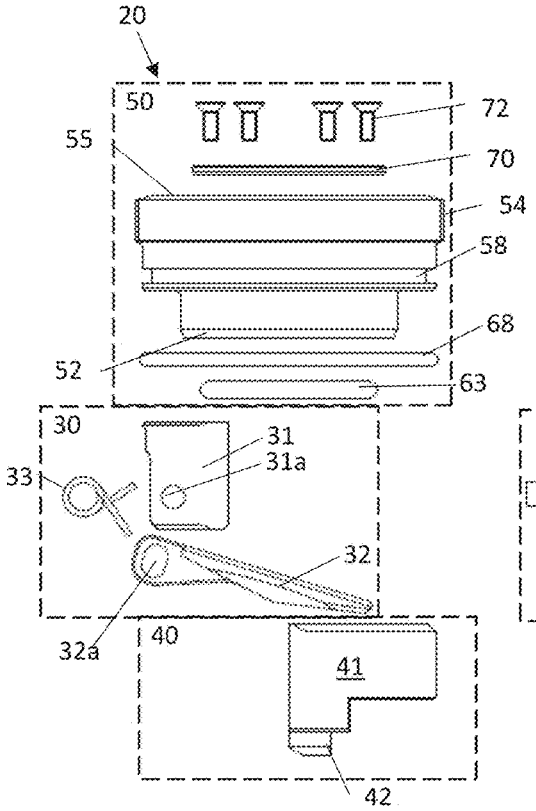
FIG. 11 illustrates an exploded side view of the valve assembly.
Figure 12:
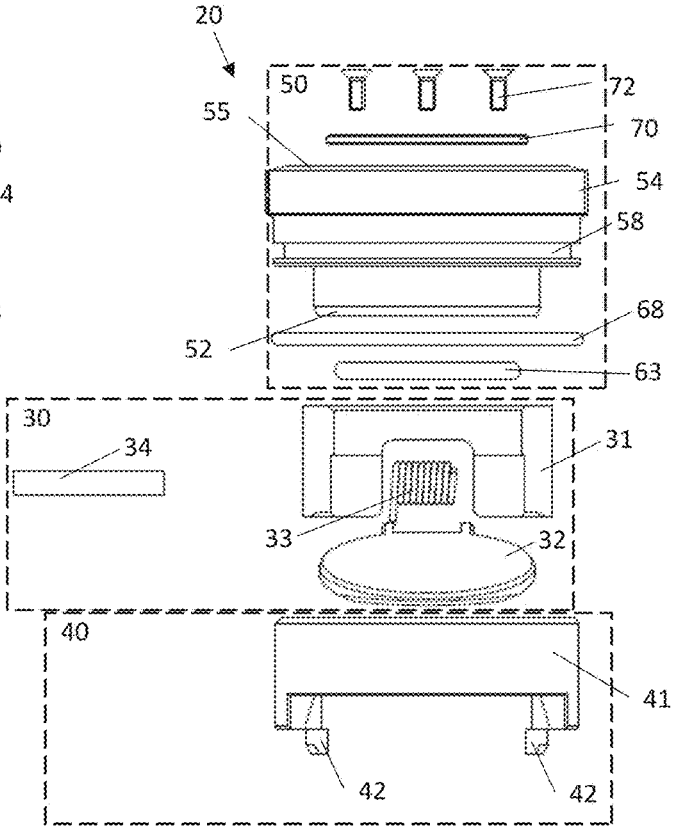
FIG. 12 illustrates an exploded rear view of the valve assembly.

It is now referred to FIGS. 11 and 12, which are exploded views of the valve assembly 20 seen from two different sides. Here, the different parts of the valve assembly 20 are separated into three main parts as indicated by dashed boxes. These main parts, comprising a flapper valve device 30, a flapper element supporting device 40 and securing device 50 will be described in detail below. Then the installation of the valve assembly 20 to the production tubing sub 10 will be described, and finally the use of the production tubing system 1 with such a production tubing sub 10 will be described.

The Flapper Valve Device 30

It is now referred to FIGS. 11 and 12. The flapper valve device 30 comprises a flapper aligning body 31 having a pin opening 31*a*. In addition, the flapper valve device 30 comprises a flapper element 32 having a pin opening 32*a*. The flapper element 32 is pivotably connected to the flapper aligning body 31 by means of a pin fastener 34 inserted through the pin openings 31*a*, 32*a*. The flapper aligning body 31 is configured to be aligned in a predetermined position with respect to the housing 12. One way of achieving this is to provide the opening 16 in the housing 12 with a recess or supporting surface 16*a* adapted to the shape of the flapper aligning body 31 which will prevent movement of the flapper aligning body 31 with respect to the opening 16 of the housing 12. This supporting surface 16*a* will be described further in detail below with respect to FIGS. 14*e* and 14*f*.

As shown in the drawings, the flapper aligning body 31 is generally U-shaped.

In addition, the flapper device 30 comprises a coiled spring 33, for biasing the flapper element 32 with respect to the flapper aligning body 31. As the flapper aligning body 31 is configured to be aligned in a predetermined position with respect to the housing 12, the spring device 33 is also biasing the flapper element 32 with respect to the housing 12 when the valve assembly 20 is provided in its position in the opening 16 of the housing 12.

The Flapper Element Supporting Device 40

The main purpose of the flapper element supporting device 40 is to support the flapper element 32 when the flapper element 32 is in its open position.

In FIG. 14*a-d*, it is shown that the flapper element supporting device 40 comprises a flapper element supporting body 41 having two stop elements 42. The flapper element supporting body 41 is generally U-shaped, where one stop element 42 is provided in each end of the generally U-shaped flapper element supporting body 41.

Figure 8:
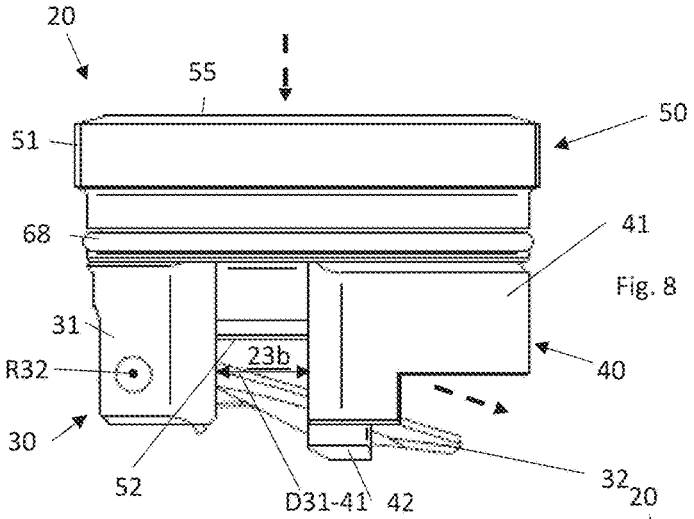
FIG. 8 illustrates a side view of the valve assembly.
Figure 9:
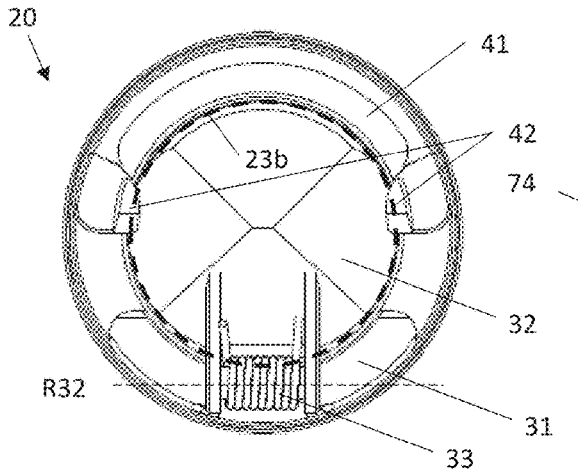
FIG. 9 illustrates a bottom view of the valve assembly.
Figure 10:
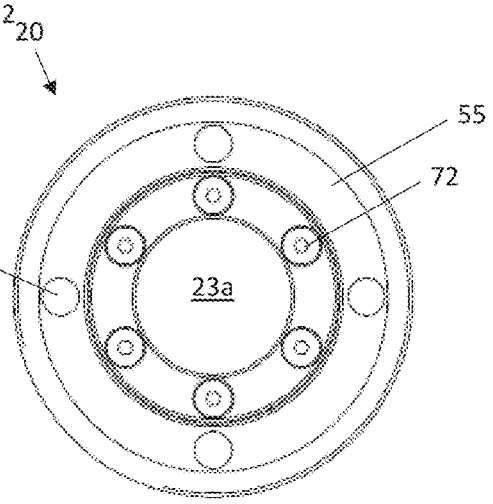
FIG. 10 illustrates a top view of the valve assembly.

The generally U-shaped flapper aligning body 31 and the generally U-shaped flapper element supporting body 41 have their respective ends faced towards each other, thereby forming a substantially circular compartment 23*b*, as shown in FIGS. 8 and 9. In FIG. 9, this substantially circular compartment 23*b* is indicated as a dashed circle.

The flapper element supporting body 41 is, similar to the body 31, configured to be aligned in a predetermined position with respect to the housing 12. One way of achieving this is to provide the opening 16 in the housing 12 with a recess or supporting surface 16*b* adapted to the shape of the flapper element supporting body 41 which will prevent movement of the flapper element supporting body 41 with respect to the opening 16 of the housing 12. This supporting surface 16*b* will be described further in detail below with respect to FIGS. 14*e* and 14*f*.

In the area between the stop elements 42, the flapper element supporting body 41 comprises a fluid guiding surface 48 (FIG. 14*a*, 14*b*) facing towards the flapper element 32 and hence towards the substantially circular compartment 23*b*.

It should be noted that the flapper element supporting body 41 may comprise one or more than two such stop elements 42. In the present embodiment, the body 41 and the stop elements 42 are provided as one body. It should be noted that in alternative embodiments, the flapper element supporting device 40 may comprise the body 41 and stop elements 42 as separate elements connected to each other.

The Securing Device 50

The securing device 50 will now be described with reference to FIGS. 4-8, 12 and 13, where it is shown that the securing device 50 comprises a securing body 51. The securing body 51 is substantially cylindrical, where the axis L20 indicates the longitudinal axis of the cylindrical securing body 51. The securing body 51 comprises a through bore indicated as 23*a* in parallel with the axis L20.

The securing body 51 comprises first end surface, hereinafter referred to as a flapper element facing surface 52 faced towards the flapper element 32. In the present embodiment, the flapper element facing surface 52 forms a plane perpendicular to the axis L20. When the valve assembly 20 is installed in the opening 16 of the housing, as shown in FIGS. 4 and 5, the flapper element facing surface 52 is also facing inwardly towards the bore 13 of the housing 12.

Figure 13:
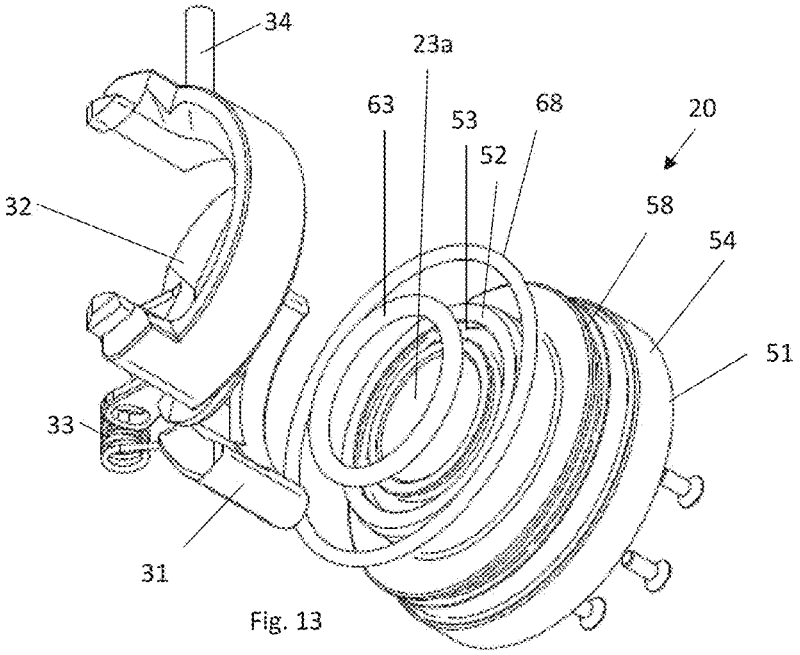
FIG. 13 illustrates an exploded perspective view of the valve assembly.

The securing body 51 further comprises a circular recess 53 provided in the flapper element facing surface 52 surrounding the bore 23*a*, as shown in FIG. 13.

The securing body 51 further comprises a second end surface 55 provided in the opposite end of the first end surface 52. The second end surface 55 comprises a tool connection interface 74 in the form of four circular grooves provided in the second end surface 55.

The securing body 51 further comprises a threaded surface 54 provided circumferentially around the outside of the securing body 51. The threaded surface 54 is adapted to be secured to a correspondingly threaded surface provided in the opening 16.

Between the threaded surface 54 and the flapper element facing surface 52, the securing body 51 comprises a circular recess 58 circumferentially around the outside of the securing body 51.

The securing device 50 comprises a first sealing element 63 provided in the recess 53 and a second sealing element 68 provided in the recess 68.

The purpose of the first sealing element 63 is to provide a seal between the flapper element facing surface 52 and the flapper element 32 when the flapper element 32 is in the closed position. The purpose of the second sealing element 68 is to provide a seal between the securing body 51 and the housing 12, i.e. to prevent fluid flow through the opening 16 radially outside of the securing body 51.

In the present embodiment, the securing device 50 comprises a filter 70 to prevent debris from entering the fluid communication channel 23. The filter 70 is connected to the second end surface 55 by means of screws or other fasteners 72. In the present embodiment, the filter 70 comprises a mesh with 2.0×2.0 mm openings. It should be noted that the valve assembly 20 may be used with other types of filters and also without any filter.

Installation of the Valve Assembly 20 into the Production Tubing Sub 10

The installation of the valve assembly 20 to the opening 16 of the housing 12 of the well tool device 10 will now be described. The well tool device 10 is here a production tubing sub shown in FIGS. 2 and 3. However, the well tool device 10 may also be used in other types of well tool devices.

As described above, the valve assembly 20 comprises three main parts; the flapper valve device 30, the flapper element supporting device 40, and the securing device 50.

Details of the opening 16 will now be described with reference to FIGS. 14*e* and 14*f*.

The opening 16 comprises a first supporting surface 16*a* shaped to receive and support the flapper aligning body 31 and a second supporting surface 16*b* shaped to receive and support the flapper element supporting body 41. The opening 16 further comprises two spacer elements 16*c* protruding towards the center axis L20 of the valve assembly L20, which in the present embodiment is substantially similar to the center axis of the opening 16.

Hence, the supporting surfaces 16*a*, 16*b* and the spacer elements 16*c* together form two recesses, one for each of the bodies 31, 41.

In FIG. 8, it is shown that there is an area having a distance D31-41 between the first and second bodies 31, 41. When the valve assembly 20 is installed in the opening 16 of the sub, the spacer element 16*c* will be located in this area between the first and second bodies 31, 41. Hence, the spacer element 16*c* also forms a part of the circular compartment 23*b* as shown in FIG. 9.

First, the flapper element supporting device 40 is inserted in the opening 16 into contact with the second supporting surface 16*b*. Then, the flapper valve device 30 is inserted in the opening 16 into contact with the first supporting surface 16*a*.

In a final step, a tool (not shown) and the tool connection interface 74 are used to screw the securing device 50 into the opening 16 and hence connect the threads 54 to the threads of the opening 16.

Consequently, the securing device 50 is used to secure the devices 30, 40 to the opening 16 in an easy and effective way. An alternative, but more complex solution, would be to use separate fasteners to secure the devices 30, 40 to the opening 16, before the securing device 50 is secured to the opening 16.

It is now referred to FIG. 5, where it is shown that the flapper element 32 is sealingly engaged towards the sealing element 63 and the flapper element facing surface 52. The flapper element 32 here preferably oriented in parallel with the longitudinal axis L12 of the housing 12, as indicated by an angle $\alpha=0°$ between the flapper element facing surface 52 and the flapper element 32.

It is now referred to FIG. 4, where it is shown that the flapper element 32 is engaged or supported towards the stop elements 42 of the flapper element supporting body 41. The angle $\alpha$ between the flapper element facing surface 52 and the flapper element 32 is here shown to be ca 25°. However, other angles are possible, the angle $\alpha$ may be in the range 5°-45°. Two of the factors for determining how large the angle $\alpha$ may be, is the housing thickness T12 indicated in FIG. 4 and of course the size of the flapper element 32 needed to prevent fluid flow through the bore 23*a*.

A rotation axis R32 of the flapper element 32 is indicated in FIG. 4. This rotation axis R32 is perpendicular to the longitudinal axis L12 of housing 12. Preferably, the rotation axis R32 of the flapper element 32 is also perpendicular to the longitudinal axis L20 of the valve assembly 20. In one aspect, the rotation axis R23 of the flapper element 32 is provided in the upper part of the opening 16, i.e. closer to the topside of the well than the bottom of the well.

In FIG. 4, the bore 13 of the housing 12 is indicated as a dashed line. As shown here, the stop elements 42 are preventing the flapper element 32 from protruding into the bore 13 when the flapper element 32 is in its open position. In addition, the stop elements 42 are not protruding into the bore 13 of the housing 12. Hence, fluid flow through the bore 13 is not restricted by any parts of the valve assembly 20. Moreover, it is achieved that intervention tools may pass through the bore 13 without being restricted by any parts of the valve assembly 20.

In FIG. 4, it is also shown that the fluid communication channel 23 through the valve assembly 20 is formed by two parts, the first part being the bore 23*a* through the securing element 51 and the second part being the substantially circular compartment 23*b* formed between the two substantially U-shaped bodies 31, 41.

The fluid flow from the outside O and into the bore 13 via the bore 23*a* is deflected by the flapper element 32 in the compartment 23*b*. The fluid will follow the dashed line in FIG. 4 and FIG. 8, i.e. through the bore 23*a*, through the compartment 23*b* and out between the flapper element 32 and the fluid guiding surface 48 and further into the bore 13.

By means of this design, in particular to the circular bore 23*a* and the substantially circular compartment 23*b*, the risk for debris etc. to accumulate is reduced. Consequently, the risk for such debris to obstruct the movement of the flapper element 32 is reduced.

As described above, the flapper element 32 is biased to the closed position by means of a biasing force provided by the spring device 33. The flapper element 32 is configured to be brought from its closed position to its open position when a force created by the differential fluid pressure between the outside O of the housing 12 and the bore 13 is above a predetermined threshold value Pthreshold, where this predetermined threshold value is given by the biasing force of the biased flapper element 32. More specifically, the flapper element 32 may be pivoted with respect to the flapper aligning body 31 as long as the pivoting force is larger than the biasing force provided by the spring device 33.

The predetermined threshold value is positive, i.e. the fluid pressure on the outside O of the housing 12 must be larger than the fluid pressure in the bore 13 to bring the flapper element 32 from the closed position to the open position.

Operation of the Production Tubing Sub

The production tubing sub is used during the installation of a production tubing system 1 in a well. This will be described in detail below with reference to FIGS. 15*a-c*.

It is now referred to FIG. 15*a*. Here the production tubing system 1 for the oil and/or gas well W is shown. A production tubing 2 has a through bore 3 in its longitudinal direction I, where the production tubing 2 is hung off by means of a tubing hanger 8.

The system 1 comprises an upper safety valve 7 located in the upper part of the production tubing 2, a lower valve 4 located in the lower part of the production tubing 2 and a packer assembly 6. The packer assembly is provided for closing an annulus A outside of the production tubing 2 above the lower valve 4. The annulus A here corresponds to the outside O shown in FIGS. 2 and 3.

The system 1 further comprises a production tubing sub 10 with one or more valve assemblies 20. The production sub 10 is connected to the production tubing 2 above the lower valve 4 and below the packer assembly 6.

Optionally, the production tubing system 1 may also comprise an upper valve 5 located in the upper part of the production tubing 2.

The lower valve 4 is initially closed. The upper valve 5 and the safety valve 7 are both open.

No fluid will be added into the tubing string 2 from the topside as the tubing string is lowered into the well. Hence, as the tubing string is moved downwardly, the fluid pressure outside of the tubing string 2 will be higher than the fluid pressure inside of the tubing string. Hence, the fluid pressure difference will bring the valve assembly to its open state and fluid will enter the tubing string. Hence, one advantage of the production tubing sub 10 is that it enables self-filling during installation of the production tubing system 1.

In FIG. 15*a*, is also possible to use the production tubing sub 10 to circulate fluid, for example to replace one well fluid with a different well fluid, for example to replace a light fluid with a heavier fluid for well control purposes etc. This is done by pumping the new fluid down the annulus A and receive the previous fluid up through the tubing string.

When the tubing string has been held in the desired position for a while, the pressure inside the tubing will be substantially equal to the fluid pressure outside of the tubing string and the valve assembly will close due to the biased flapper element 32.

Alternatively, the fluid inside of the tubing string 2 is increased relative to the annulus fluid pressure by means of a pumping device etc., thereby closing the valve assembly 20.

The fluid pressure is now increased further, to set the fluid pressure actuated packer assembly, as shown in FIG. 15*b*.

In prior art, a well intervention operation is normally necessary here, to set/retrieve a plug in the lower end of the tubing string. However, as the lower plugging device 4 is closed and the production tubing sub 10 allows flow in one direction only, this well intervention operation is no longer needed.

The integrity of the set packer assembly 6 may now be tested by increasing the pressure in the annulus A above the packer assembly. If the packer assembly is leaking, this will cause the fluid pressure below the packer assembly 6 to increase. This again will cause the valve assembly 20 to open, and fluid will exit from the top of the production tubing. If the packer assembly 6 is not leaking, no fluid will exit from the top of the production tubing.

As the volume of the well W below the packer assembly 6 can be limited/small it can be difficult to know that the packer assembly is holding the pressure. Hence, to verify that it actually is the packer assembly that is tested (and not the closed well volume below the packer assembly), this test of packer assembly is considered more reliable and efficient.

After the testing of the packer assembly, the lower valve 4 can be brought to a permanently open state by means of fluid pressure pulses, and production may start.

After the packer assembly is set and the well is tested the upper valve 5 can be closed. It can act as a shallow barrier enabling removal of BOP. After x-mas tree is installed the upper valve 5 can be opened and production may start.

Alternative Embodiments

It is now referred to FIGS. 16 and 17. Here, the well tool device 10 comprises an axially displaceable sleeve 80, which may be used to prevent fluid flow through the valve assembly 20 even if the fluid pressure difference between the outside of the housing and the inside of the housing is larger than the predetermined fluid pressure threshold value.

Hence, prior to closing the sleeve 80, the sub 10 can be used for self-filling and/or circulation purposes, as described above.

In addition, when the sleeve 80 is (permanently) closed it can be used as a barrier between the annulus and the bore of the tubing.

It should be noted that with this sleeve 80, the sub may be located above the packer for self-filling purposes and for displacing well fluid between the annulus and tubing without circulate past the packer assembly.

The invention claimed is:

1. A valve assembly for connection to an opening provided in a housing of a well tool device, the valve assembly comprising:

a fluid communication channel providing fluid communication from an outside of the housing to a bore provided on an inside of the housing;

a flapper valve device comprising a flapper element configured to be in a closed position in which the fluid communication channel is closed and an open position in which the fluid communication channel is open, the flapper element being biased to the closed position;

a flapper element supporting device configured to support the flapper element when the flapper element is in the open position; and a securing device for securing the flapper valve device and the flapper element supporting device to the opening, the securing device comprising a through bore forming a first part of the fluid communication channel.

2. The valve assembly according to claim 1, wherein the flapper element is configured to be brought from the closed position to the open position when a force created by a differential fluid pressure between the outside of the housing and the bore is above a predetermined threshold value.

3. The valve assembly according to claim 1, wherein the flapper valve device comprises a flapper aligning body configured to be aligned in a predetermined position with respect to the housing, wherein the flapper element is pivotably connected to the flapper aligning body.

4. The valve assembly according to claim 3, wherein the flapper valve device comprises a spring device biasing the flapper element in relation to the flapper aligning body.

5. The valve assembly according to claim 3, wherein the flapper element supporting device comprises a flapper element supporting body comprising a stop element for preventing the flapper element from protruding into the bore when the flapper element is in the open position.

6. The valve assembly according to claim 5, wherein the flapper element supporting body comprises a fluid guiding surface facing towards the flapper element.

7. The valve assembly according to claim 5, wherein the aligning body and the flapper element supporting body are both generally U-shaped, wherein ends of the generally U-shaped bodies are facing each other, thereby forming a substantially circular compartment forming a second part of the fluid communication channel.

8. The valve assembly according to claim 1, wherein the securing device comprises a securing body having a flapper element facing surface facing towards the flapper element, the flapper element facing surface comprising a recess in which a scaling element is provided, wherein the flapper element is sealingly engaged towards the flapper element facing surface when the flapper element is in the closed position.

9. The valve assembly according to claim 8, wherein the securing body comprises a recess in which a sealing element is provided, wherein the sealing element is configured to prevent fluid flow through the opening radially outside of the securing body.

10. The valve assembly according to claim 8, wherein the securing device comprises a filter to prevent debris from entering the fluid communication channel.

11. A production tubing sub for a production tubing system, the production tubing sub comprising:

a housing comprising a longitudinal through bore, wherein the longitudinal through bore is configured to be provided in fluid communication with a through bore of a production tubing;

an opening provided radially in the housing; and a valve assembly secured to the opening of the housing, the valve assembly comprising:

a fluid communication channel providing fluid communication from an outside of the housing to the longitudinal through bore of the housing;

a flapper valve device comprising a flapper element configured to be in a closed position in which the fluid communication channel is closed and an open position in which the fluid communication channel is open, the flapper element being biased to the closed position;

a flapper element supporting device configured to support the flapper element when the flapper element is in the open position; and a securing device for securing the flapper valve device and the flapper element supporting device to the opening, the securing device comprising a through bore forming a first part of the fluid communication channel.

12. A production tubing system for a well, comprising:

a production tubing comprising a through bore in a longitudinal direction;

a tubing hanger for hanging off the production tubing in the well;

an upper safety valve located in an upper part of the production tubing;

a first, lower valve located in a lower part of the production tubing; and a packer assembly for closing of an annulus outside of the production tubing above the lower valve;

wherein the system further comprises:

a production tubing sub located in the production tubing above the lower valve, the production tubing sub comprising:

a housing comprising a longitudinal through bore, wherein the longitudinal through bore is configured to be provided in fluid communication with the through bore of the production tubing;

an opening provided radially in the housing; and a valve assembly secured to the opening of the housing.

13. The production tubing system according to claim 12, wherein the production tubing sub is located in the production tubing below the packer assembly.

14. The production tubing system according to claim 12, wherein the system further comprises a second, upper valve located in the upper part of the production tubing.

15. A method for installing a production tubing system in a well comprising:

lowering a production tubing comprising a longitudinal through bore into the well, wherein an initially closed lower valve is located in a lower part of the production tubing, wherein an upper safety valve is located in an upper part of the production tubing; and wherein a production tubing sub is located in the production tubing above the lower valve;

allowing well fluid to enter the through bore via a valve assembly secured to an opening of a housing of the production tubing sub during the lowering of the production tubing into the well;

closing the valve assembly by increasing a pressure inside the bore with respect to a pressure outside of the production tubing; and setting a packer assembly in an annulus outside of the production tubing above the production tubing sub by means increasing the pressure inside the bore.

16. The method according to claim 15, further comprising the step of:

testing an integrity of the packer assembly by increasing the pressure in the annulus radially outside of the production tubing above the packer assembly;

verifying the integrity of the packer assembly if no fluid flow up through the bore of the production tubing via the valve assembly is detected; or verifying a failed integrity of the packer assembly if fluid flow up through the bore of the production tubing via the valve assembly is detected.

17. The method according to claim 16, further comprising:

opening the lower valve if the integrity of the packer assembly has been verified.

18. The method according to claim 15, wherein the step of allowing well fluid to enter the through bore is performed as long a differential fluid pressure between the outside of the housing and the bore is above a predetermined threshold value.

19. The method according to claim 15, wherein the production tubing system comprises:

the production tubing sub comprising:

the housing comprising a longitudinal through bore, the longitudinal through bore being configured to be provided in fluid communication with the through bore of the production tubing;

the opening provided radially in the housing; and the valve assembly secured to the opening of the housing, the valve assembly comprising:

a fluid communication channel providing fluid communication from an outside of the housing to the longitudinal through bore of the housing;

a flapper valve device comprising a flapper element configured to be in a closed position in which the fluid communication channel is closed and an open position in which the fluid communication channel is open, the flapper element being biased to the closed position;

a flapper element supporting device configured to support the flapper element when the flapper element is in the open position; and a securing device for securing the flapper valve device and the flapper element supporting device to the opening, the securing device comprising a through bore forming a first part of the fluid communication channel.

* * * * *